United States Patent [19]

Lueneburger

[11] Patent Number: 4,792,776

[45] Date of Patent: Dec. 20, 1988

[54] MINIATURIZED ELECTROMAGNETIC RELAY FOR SWITCHING HIGH VOLTAGES

[75] Inventor: Klaus Lueneburger, Evansville, Ind.

[73] Assignee: Siemens Aktiengesellschaft, Berlin and Munich, Fed. Rep. of Germany

[21] Appl. No.: 100,693

[22] Filed: Sep. 24, 1987

[51] Int. Cl.[4] ..... H01H 51/22

[52] U.S. Cl. ..... 335/80; 335/83; 335/85

[58] Field of Search ..... 335/78–83, 335/120, 124, 128, 129, 130

[56] References Cited

U.S. PATENT DOCUMENTS 4,720,694 1/1988 Schroeder ..... 335/81

*Primary Examiner*—E. A. Goldberg
*Assistant Examiner*—Lincoln Donovan
*Attorney, Agent, or Firm*—Moran, John Francis

[57] ABSTRACT

A miniature relay (1) capable of switching high currents combines the armature spring function with that of at least one (72, 73) movable contact. One end (71) of the spring is attached to the core (3) while the other end (75) is movable and attached to the armature (75) in the vicinity of the working air gap (36). Variously shaped springs are utilized to support the movable contact and mechanically bias the armature to maintain the working air gap.

14 Claims, 5 Drawing Sheets

MINIATURIZED ELECTROMAGNETIC RELAY FOR SWITCHING HIGH VOLTAGES

BACKGROUND OF THE INVENTION

1. Field of the Invention

This invention relates to electromagnetic relays having a base body, a coil including a core, and an armature associated with core for actuating a contact assembly. In particular, the invention relates to a miniaturized relay having this structure which is able to switch even higher voltages.

2. Prior Art

Many types of relays for switching high voltages are known in the art, comprising usually a coil with a core and an armature, where a contact set is actuated by said armature. Normally in these relays, the contact spring or springs are actuated by the armature immediately or via pusher urging the contact spring or springs in a direction which is generally perpendicular to its longitudinal extension. Therefore, it is apparent that the switching distance of the switching contact cannot be longer than the stroke of the armature since the armature stroke determines the contact distance which an be used in that relay. If the magnet system of the relay is miniaturized, the effective lever arm of the armature will also be shortened and the available contact distance will be reduced as well. For high voltage relays, however, the requirement of a predetermined minimum contact distance is indispensible, thus preventing miniaturization of relays of this type.

SUMMARY OF THE INVENTION

One primary object of the present invention is to provide a miniaturized electromagnetic relay effective to switch high voltages.

Another object of the present invention is to provide a miniaturized electromagnetic relay which provides large contact distances compared with the size and stroke of the armature.

Yet another object of the present invention is to provide a miniaturized electromagnetic relay which is simple in design and can easily be manufactured and assembled.

Still another object of the present is to provide a miniaturized electromagnetic relay which provides good insulative properties between the switching contact elements and the coil arrangement.

These and other objects are achieved in accordance with the present invention by an electromagnetic relay which comprises:

a base body having at least a flat bottom side;

a coil arranged on said base body with its coil axis parallel to said bottom side;

an angled core having at least two legs perpendicular to each other, both extending parallel to the bottom side, a first core leg being disposed actually within said coil and a second core leg extending outside the coil and perpendicular to said first leg;

an armature rockably seated on one free end of said core and forming a working air gap with the opposite free end of the core, which armature extends also parallel to said bottom side;

the contact assembly having at least one movable contact leaf spring and at least one counter-contact element, said contact spring and said at least one counter-contact element each having a terminal in said base body and perpendicular to the bottom side thereof;

wherein, said contact leaf spring has a first end portion fixed to its terminal, a central portion carrying one or two contacts, and a second end portion connected to a movable end portion of the armature; and the armature urges the second end portion of the contact spring essentially in its longitudinal direction controlling the amount of deflection of the center portion of the spring so as to move the contact or contacts thereon back and forth toward said at least one counter-contact element.

In a preferred embodiment, the coil, core and armature form a generally rectangular space including a contact chamber on said base body receiving said contact elements.

BRIEF DESCRIPTION OF THE DRAWINGS

The invention will now be described in detail with reference to preferred illustrative embodiments thereof, given only by way of a non-limited and indicative example, being illustrated on the accompanying drawings.

DESCRIPTION OF THE PREFERRED EMBODIMENTS

Figure 1:
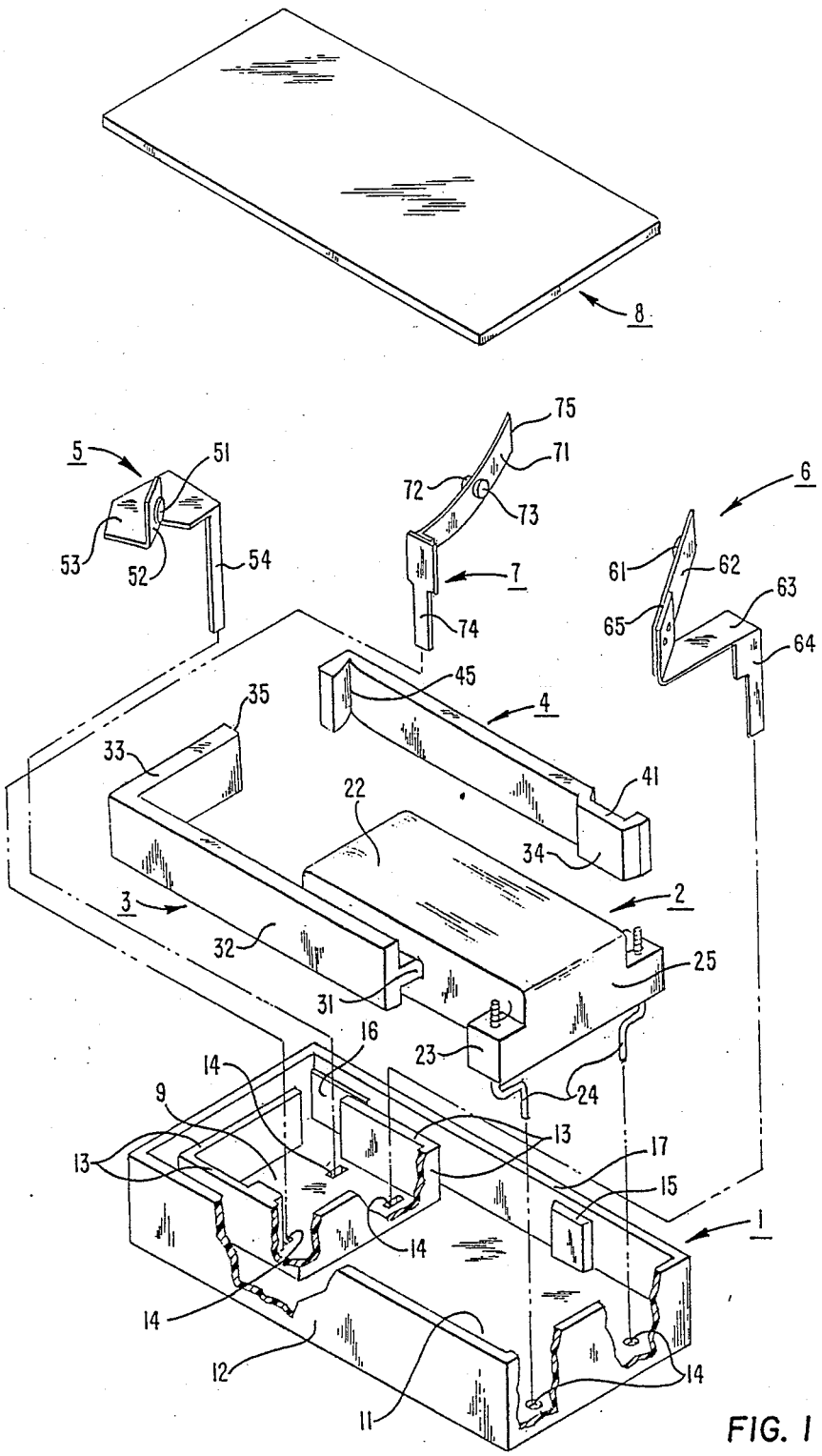
FIG. 1 is an enlarged exploded view of a first illustrative embodiment of a miniaturized electromagnetic relay according to the present invention.
Figure 3:
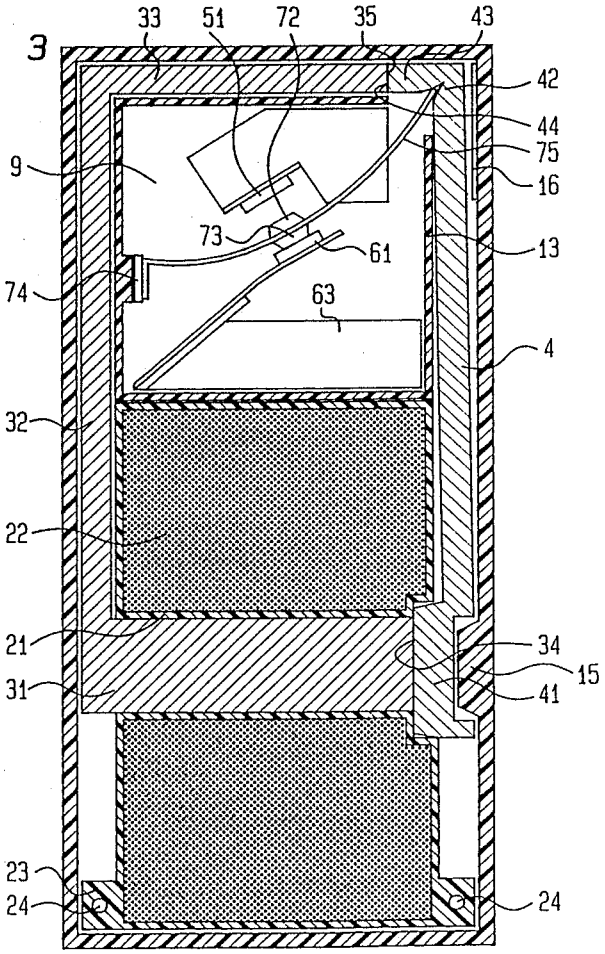
FIGS. 2 and 3 are plan and partially sectioned views showing the relay of FIG. 1 in its unoperated and operated condition, respectively.
Figure 2:
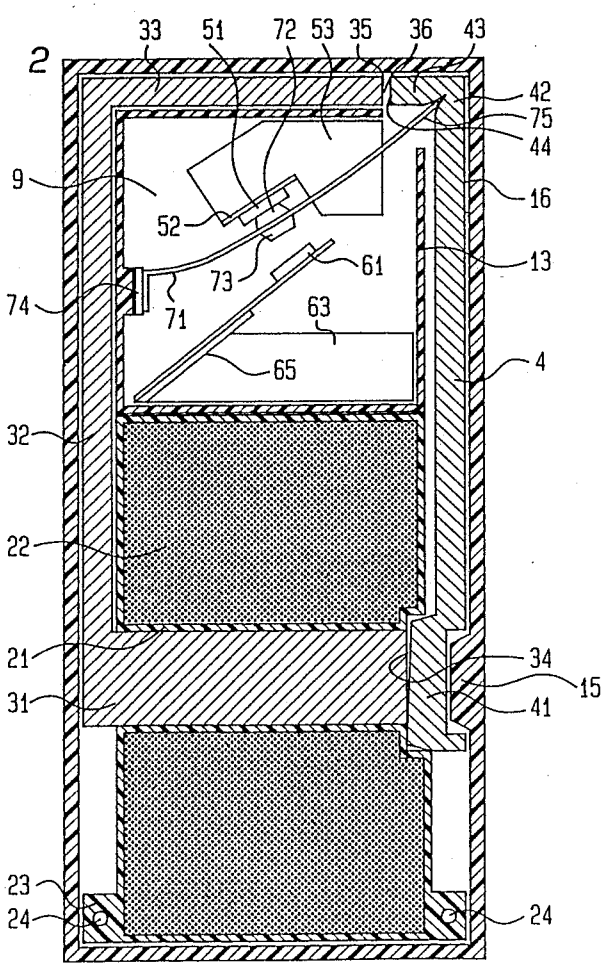

As shown in the FIGS. 1 through 3, the relay according to the first embodiment of the present invention comprises a base body 1, a coil 2, a core 3, an armature 4 and contact elements 5, 6 and 7. The base body 1 has a bottom 11 and a circumferential side wall 12 so as to form a box-like housing for the functional parts of the relays. This base body is formed from insulating plastic material in a conventional manner, for example by dye casting or injection molding. Further, the base body 1 comprises partition walls 13 perpendicular to its bottom for fixing parts and for providing insulation between metallic parts of the relay. The bottom 11 has through holes 14 for receiving and fixing terminal elements for contact and coil ends. In addition, the side walls 12 provide a bearing edge 15 and a stopper 16 for the armature 4.

The electromagnetic system comprises a coil 2 with a coil body or coil former 21 carrying a winding 22, the coil body 21 having extensions 23 wherein terminal pins are anchored and connected to the respective ends of the winding 22. In the illustrated embodmment, the coil is shown as being embedded entirely within an insulative material which also forms covering 25, for example by injection molding. However, insulation between the coil winding 22 and other metallic parts of the relay, for example the contact elements, may also be achieved through other conventional manners. For example, the coil may be inserted into a preformed insulating cap or coil housing. Further, as an additional insulation between the coil and the contact, the base body has partition walls 13 as described above. As shown further in FIG. 1, the terminal pins 24 are bent or cranked underneath the coil so as to fit into a predetermined pattern or raster of terminals.

The ferromagnetic core 3 generally includes three legs, a first core leg 31 disposed in an axially within the coil, a second core leg 32 extending outside the coil perpendicular to said first core leg, and a third core leg 33 extending perpendicular to said second core leg and parallel to said first core leg and having a predetermined distance from said coil. The first core leg at its free end providing a bearing surface 34 for the armature 4. Further, the third core leg 33 also has free end serving as a pole surface 35 while facing a free end 44 of the armature 4.

The armature 4 is generally elongated or bar-shaped. Its first end 41 is slightly tapered so as to form a bearing portion capable of being pivoted on the bearing surface 34 of the core leg 31 and is secured against removal in its bearing position by the bearing projection 15 of the base body 1. The end 42 of the armature 4 has a short angled arm 43 which provides a moving pole surface 44 that faces the pole surface 35 of the core. A working air gap 36 is present between poles 35 and 43. In the angle between the main part of (first arm) the armature 4 and the small bent arm 43, a slot 45 is formed for receiving one end of the contact spring 7. This slot, however, could be formed also without having a bent arm 43.

The contact assembly comprises a first stationary counter-contact element 5 carrying a normally closed contact 51 on an upright portion 52 of the first counter-contact element. Upright portion 52 is supported by a center portion 53 which rests flat on the bottom 11 of the base body 1. A second counter contact element 6 provides a normally open contact 61 supported on a resilient portion 62 which is made from a blade spring and fastened to the second counter-contact element 6 by any conventional method, such as riveting or welding. A center portion 63 is disposed parallel to and resting on said bottom 11 of the base body. Each of the counter-contact elements 5 and 6 have a terminal 54 and 64, respectively, formed as an integer part of the elements. The moving or rotor portion in the contact assembly is the contact spring 7 having a spring blade 71 with a contact 72 and 73 on each lateral side to make and break contact with the respective contacts 51 and 61. The contact spring 7 has a terminal 74 which is connected to the contact spring by any conventional method such as riveting or welding.

Further, the relay has a cover 8 which is Illustrated in FIG. 1 as being plate-like. This cover can be connected to the upper edge 17 of the side walls 12 of the base body 1 by applying adhesive or ultrasonic welding or by any other conventional method. The cover 8 may also have any other suitable shape to fit on the base body 1 and to be sealed, if necessary.

The assembling of the relay illustrated in FIGS. 1 to 3 will now be described in more detail. First, the parts as shown in FIG. 1 are prefabricated and the core is inserted with its first core leg 31 into an axial hole of the coil. Then, the unit of coil and core formed in this way is inserted into the base body while its core leg 32 and 33 are clamped between the side walls 12 and the partition walls 13 of the base body 1. The contact elements are mounted by inserting the terminals 54, 64 and 74 into appropriate holes 14 of the base body. After that, the armature 4 is inserted in the space between the coil and the side walls 12 of the base body. With this step, the free end 75 of the contact spring 7 is inserted into the slot 45 of the armature. If necessary, the contact elements, in particular the second counter-contact element 6, can be adjusted by bending, for example by bending the portion 65. The relay is now completed by putting the cover 8 onto the base body 1 and sealing the gap therebetween, if necessary.

The functional operation of the relay described above, can easily be understood from FIGS. 2 and 3. FIG. 2 shows the relay in its unoperated condition when the coil is not excited. In this condition, the contact spring 71 is allowed to relax and tends to become straighten while pressing the armature 4 into its rest position against the stopper 16 of the base body. In this position, the contact 72 is connected to the contact 51 forming a normally closed contact. When the coil is excited and the armature 4 is attracted to the yoke leg 33, the contact spring blade 71 is compressed by the movement of the armature 4 and is deflected and closes the normally open contact between the contact pieces 73 and 61. This is the position illustrated in FIG. 3.

In the remaining Figures various modified illustrative embodiments are depicted. In these Figures, the base body and coils are shown only schematically. In all these embodiments, these parts are substantially structured in the same way as in the embodiment of FIG. 1 and only modified for adaption to different shapes of the core, armature or contact elements.

Figure 5:
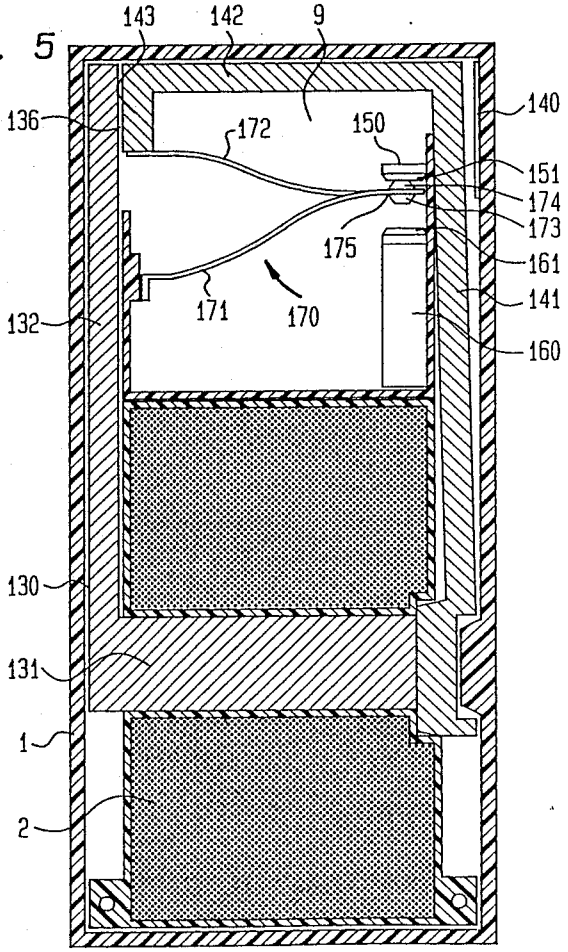
FIGS. 4 and 5 are plan views similar to FIGS. 2 and 3, but illustrating a relay wherein the armature and contact have different structures.
Figure 4:
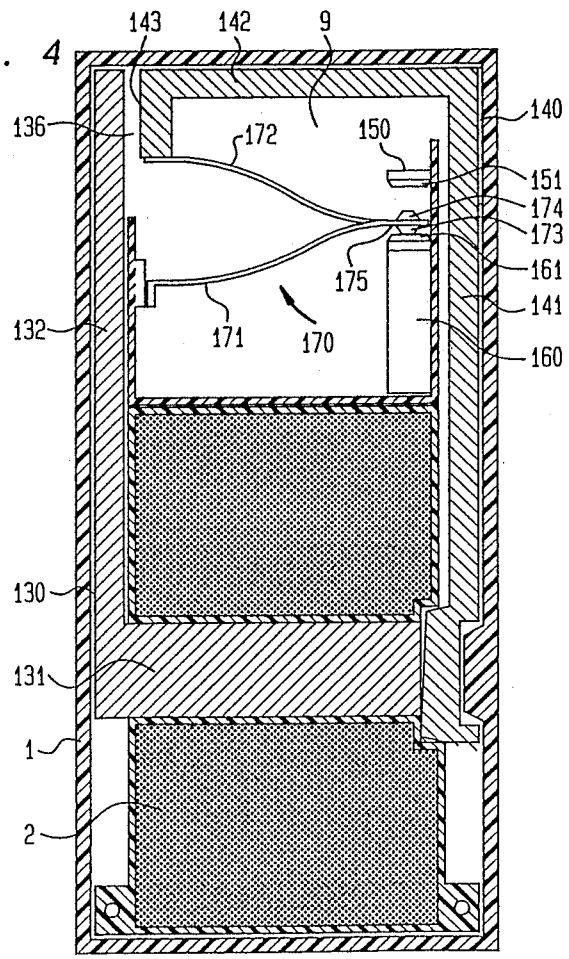

FIG. 4 and 5 illustrate a modified relay having a base body 1 and coil 2 like the relay of FIG. 1. A core 130 comprises a first core leg 131 which is disposed within the coil 2 and a second core leg 132 extending perpendicular to the first core leg 131 outside the coil. An armature 140 has a first armature arm 141 having a structure similar to the armature 4 illustrated in FIGS. 1 to 3 and a second armature arm 142 extending perpendicular to the first arm 141 and parallel to said first core leg 131. Further, a short bent arm 143 is provided at the free end of the second armature arm 142 to provide an enlarged working air gap 136 with the second core leg 132. Like in FIGS. 1 through 3, also in this embodiment the parts of the core and armature extending outside of the coil form a rectangular space to build a contact chamber 9. One main advantage of this structure results from the fact that with this structure the armature lengths of the relay has the longest possible extension within the volume of the relay, thus providing the longest possible stroke of the free end of the armature to provide also the longest possible distance between the switching contacts. Further, by urging the contact spring at least partly in its longitudinal direction, a deflection of the spring in the central portion can be even greater than the armature stroke.

In the embodiment of FIGS. 4 and 5, the contact assembly also has a different shape from the embodiment described above. The contact spring 170 consists of two spring portions 171 and 172, thus providing a bifurcated shape. These two spring arms are connected together at one end of each by welding or any other suitable way which is known to those in the art, thus forming a tip end 175 which carries a contact 173 and 174, respectively on each of its lateral side surfaces. This tip end 175 of the contact spring is disposed between the fixed contact elements 150 and 160 providing contacts 151 and 161 so as to provide a normally open and a normally closed contact with the contact spring 170.

Figure 6:
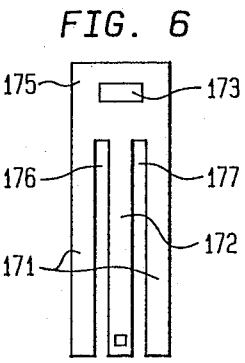
FIG. 6 is a side view of the contact spring shown in FIGS. 4 and 5.

The contact spring 170 may be made from two pieces as described above. However, it can also be made from one leaf spring piece as is shown in FIG. 6 with two slots 176 and 177. Three strips in a comb-like configuration are joined together to form the end tip 175 and bearing the contacts 173 and 174. The center strip forms the spring arm 172, while the two outer strips form the spring arm 171 carrying the switching current between the terminal 178 and the contacts 173 and 174.

Figure 7:
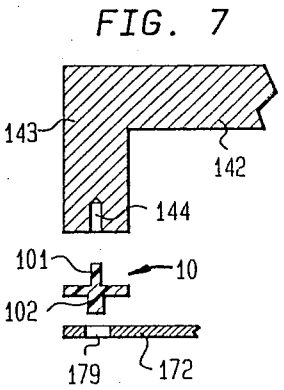
FIGS. 7 and 8 are detailed views of the connection part between the armature and the contact springs of the relay illustrated in FIGS. 4 and 5, illustrating two sequential manufacturing steps.
Figure 8:
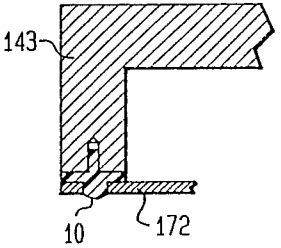

A preferential way for fastening the contact spring arm 172 to the armature arm 143 is shown in FIGS. 7 and 8, wherein insulation is provided between the armature and the contact spring. As shown in FIG. 7, a plastic rivet piece 10 is inserted with its pin 101 into a hole 144 of the armature arm 143. The contact spring arm 172 has a slot or opening 179 which is wider than a back pin 102 of the plastic rivet 10. Thus, when the armature 140 and the contact spring 170 are assembled, the recess 179 receives the back pin 102 and can be adjusted by shifting in its longitudinal direction. When the spring is adjusted, the back pin 102 of the plastic rivet is deformed by heat, for example, by generated ultrasonic equipment, thus fastening the spring arm 172 to the armature arm 143 as shown in FIG. 8.

Figure 9:
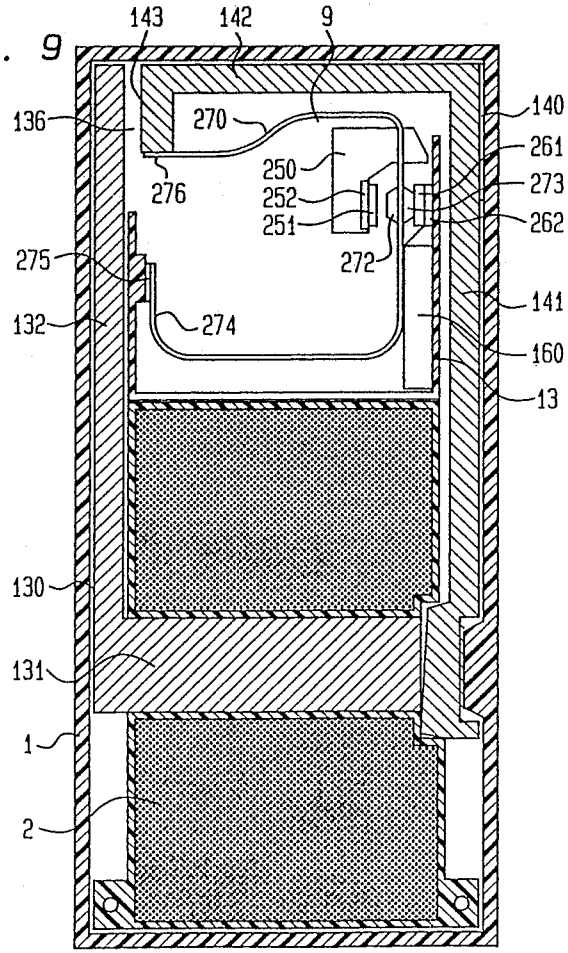
FIG. 9 is another top plan view analagous to FIG. 2 illustrating a third embodiment of the relay with a modified contact assembly.

The relay illustrated in FIG. 9 has the same general structure of the magnetic system as the arrangement of FIG. 4. So the corresponding components are provided with the same reference numerals. For information relevant to these components, reference can be made to the description of FIG. 4. In contrast to the relay of FIG. 4, the illustrative ebbodiment of FIG. 9 has a modified contact assembly which will now be described in detail.

Figure 10:
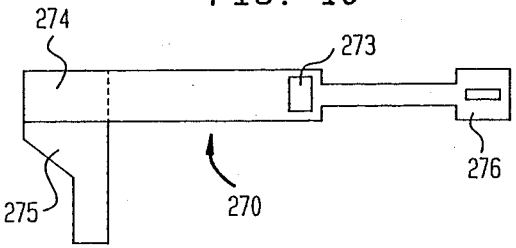
FIG. 10 is a stretched side view of the contact spring illustrated in FIG. 9.

A first counter-contact or fixed contact element 250 is provided and anchored within the base body 1 similarly to the contact element 5. This first counter-contact element 250 carries a contact 251 on its standing or vertical portion 252 for a normally open contact. A second counter-contact element 260 is also anchored in the base body 1 in a similar way as is the counter-contact element 160 in FIG. 4. This counter-contact element 260 includes a contact 261 on its standing portion 262 so as to form a normally closed contact. The contact 251 and 261 face each other and form a contact gap or contact distance in which a central part 271 of a contact spring 270 is disposed. This central part 271 carries contacts 272 and 273 on its lateral sides so as to make and break contact with opposing contacts 251 and 261. The contact spring 270 has a generally rectangular shape which is adapted approximately to the inner walls of the contact chamber which is formed by the coil 2, the core leg 132 and the armature legs 142 and 141 (it should be noted that in addition to the mentioned metallic parts the inner walls of the contact chamber are enclosed in actuallity by additional partition walls 13). The contact spring 270 which is depicted in FIG. 10 in a stretched condition, is fixed with its first end portion 274 to a terminal 275 and with a second end portion 276 to the armature arm 143. For example, it is fixed to the armature in the same way as is shown in FIGS. 4, 7 and 8.

Figure 12:
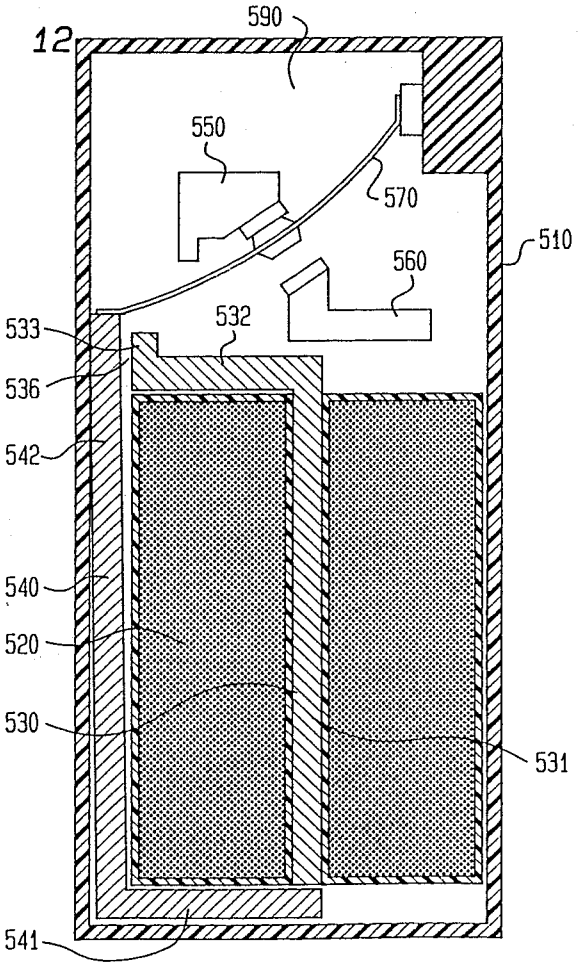
FIGS. 11 and 12 are other top plan views similar to FIG. 2 showing different modified coil and armature systems.
Figure 11:
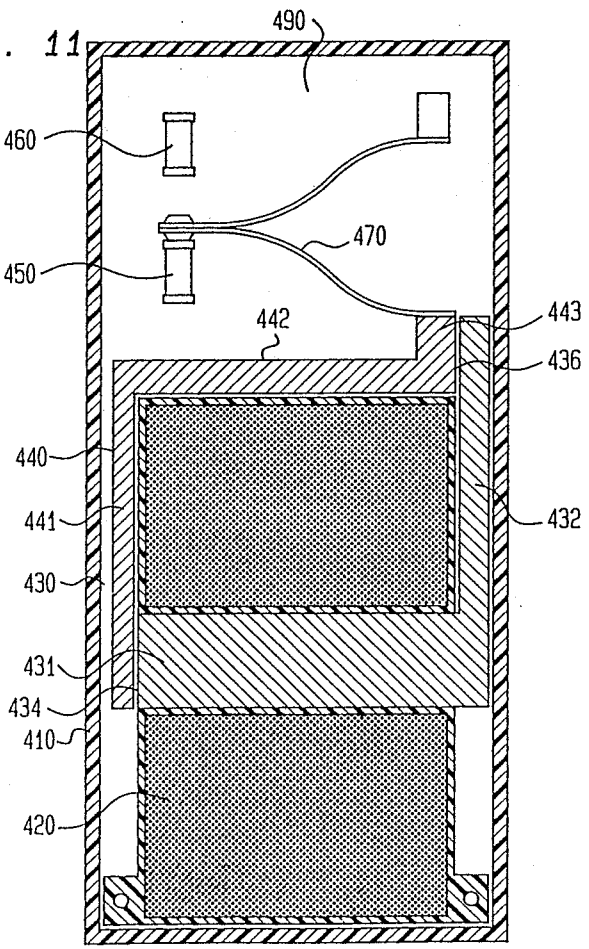

FIGS. 11 and 12, shown schematically in top views, are two further illustrative embodiments where the contact chamber is formed outside of the core and armature assembly. In these cases, insulation between the contact elements and the armature and the core can be easily achieved, but probably the stroke of the armature may be shorter than in the previous embodiments with the same size of the relay.

The relay illustrated in FIG. 11 has a base body 410 with side walls 412 which might be modified for adaption to the function and parts of the relay. A coil 420 with a structure similiar to the coil 2 of FIG. 1 is disposed on or within the coil body 410 and the core 430 is disposed with a first leg 431 within the coil 420 while a second core leg 432 extends perpendicular to the first core leg 431. A generally L-shaped armature 440 is rockably seated with a first armature arm 441 on one free end 434 of the core 430. A second arm 442 of armature 440 forms a working air gap 436 with the second core leg 432. A short bent arm 443 is provided for enlarging the area of the working air gap. It should be noted that FIG. 11 shows an actuated condition of the armature, and also that all the parts are illustrated only schematically; the details of the armature, the bearing and other parts can be readily provided by those skilled in the art. Outside of the approximately rectangular armature and core arrangement, a contact chamber 490 is provided on the base body 410. In this contact chamber, two fixed or counter-contact elements 450 and 460 and the contact spring 470 are provided which are in shape and functioning very similar to the contact elements 150, 160 and 170 illustrated in FIG. 4. Some minor modifications may be made by anyone skilled in the art. Also, additional partition walls for improving insulation between the metallic parts of the relay may be provided in accordance with the principles and concerns related in describing preceeding Figures and descriptive parts.

In FIG. 12 a further modification of the relay is illustrated. In this embodiment on a base body 510, a coil 520 is arranged with a core 530 and an armature 540. The core 530 has a first core leg 531 disposed within the coil and a second core leg 522 perpendicular to the exterior of the coil. The generally L-shaped armature is pivotally seated with one first armature arm 541 on the free end of the first core leg 531 and forms a working air gap 536 with its second armature arm 542. In order to enlarge the area of the working air gap 536, the second core leg 532 has an extension or a short bent arm 533.

Outside of the coil core and armature arrangement, a contact chamber 590 is formed on the base body 510. In this contact chamber, a contact assembly similar to that shown in FIG. 2 is provided including two fixed contact elements 550 and 560 and a contact spring 570 which is actuated by the armature in a similar way as is the contact spring 7 by the armature 4 in the first embodiment. Also, in this embodiment, a person skilled in the art may make appropriate modifications of the contact parts as well as to the other functioning parts of the relay. In particular, suitable insulation between the coil and core assembly and the contact arrangement may be provided by the use of appropriate insulation or partition walls of the base body 510.

It should be noted that still further illustrative embodiments of the present invention may be made by combining the different magnet systems and contact assemblies illustrated in the different embodiments of FIGS. 1 through 12.

There has thus been shown and described novel relay configurations which fulfill all the objects and advantages sought therefor. Many changes, modifications, variations and other uses and applications of the subject invention will, however, become apparent to those skilled in the art after considering this specification and the accompanying drawing which disclose the preferred embodiments thereof. All such changes, modifications, variations and other uses and applications which do not depart from the spirit and scope of the invention are deemed to be covered by the invention which is limited only by the claims which follow.

I claim:

1. An electromagnetic relay comprising:

(a) a base body having at least a generally flat bottom side;

(b) a coil arranged on that base body having an axis oriented parallel to said bottom side;

(c) an angled core having at least two legs perpendicular to each other, both extending along a common plane parallel to said bottom side, a first core leg being disposed axially within said coil and a second core leg extending outside the coil and perpendicular to said leg, at least the first core leg having a free end;

(d) an armature resting against the free end of said first core leg and adaptively shaped to rock thereon and another movable free end portion forming a working air gap between it and a portion of the angled core, the armature also extending parallel to said bottom side;

(e) a contact assembly having at least one movable contact mounted on a contact spring and at least one counter-contact element, said at least one movable contact and said at least one counter-contact element each electrically connected to a terminal; and (f) said contact spring having a first end rigidly secured, an accurate central portion generally longitudinally located between its first and second ends directly carrying the one movable contact, and the second end connected to the movable end portion of the armature whereby energizing the coil attracts and moves the armature in a first direction and exerts a compressional force against the second end of the contact spring to control the deflection of the central portion of the spring so as to move the at least one movable contact in a second direction different than said first direction toward said at least one counter-contact element.

2. An electromagnetic relay according to claim 1, wherein said core has a third arm extending perpendicular to said second arm and parallel to said first arm, said working air gap being formed between the free end of the armature and the portion of the angled core corresponding to a free end of the third core leg, said armature has a generally elongated shape, and said coil, said second and third core legs and said armature form a generally rectangular base on said base body including a contact chamber containing said contact elements.

3. An electromagnetic relay according to claim 1, wherein said armature is generally L-shaped having a first arm pivoted against said first core leg and a second arm extending generally perpendicular to said first armature arm and parallel to said first core leg, the free ends of said second core leg and the second armature arm forming said working air gap, and said coil, said armature and second core leg forming a generally rectangular space including a contact chamber containing said contact elements.

4. An electromagnetic relay according to claim 2, wherein said contact spring is disposed in an arched shape tranverse in the contact chamber and clamped between its terminal an the armature, its terminal carrying the first end portion of the leaf spring being anchored in the base body at one side of the contact chamber adjacent to the second core leg and the second end of the leaf spring being forced against an armature section proximate to the working air gap, the leaf spring being bent or deflected when the armature is attracted against the core and being elongated or stretched when the armature is released.

5. An electromagnetic relay according to claim 4, a pair of counter-contact elements are provided within said contact chamber carrying a pair of contacts facing each other and including the central section of the contact spring therebetween, one of the counter-contact elements being rigid and one of them being at least partly resilient, the central part of the leaf spring contacting the rigid counter-contact element when the armature is released and the resilient counter-contact element when the armature is attracted to the core.

6. An electromagnetic relay comprising:

(a) a base body having at least a generally flat bottom side;

(b) a coil arranged on that base body having an axis oriented parallel to said bottom side;

(c) an angled core having at least two legs perpendicular to each other, both extending along a common plane parallel to said bottom side, a first core leg being disposed axially within said coil and a second core leg extending outside the coil and perpendicular to said leg, at least the first core leg having a free end;

(d) an armature resting against the free end of said first core leg and adaptively shaped to rock thereon and another movable free end portion forming a working air gap between it and a portion of the angled core, the armature also extending parallel to said bottom side;

(e) a contact assembly having at least one movable contact mounted on a contact spring and at least one counter-contact element, said at least one movable contact and said at least one counter-contact element each electrically connected to a terminal; and (f) said contact spring in the form of a wishbone having two legs and an end of one of the two legs rigidly secured, a bifurcated central portion directly carrying at least one movable contact wherein the two legs are joined, and a second end of the other leg connected to the movable end portion of the armature whereby energizing the coil attracts the armature and exerts a compressional force against the second end of the contact spring to control the deflection of the central portion of the spring so as to move the at least one movable contact toward said at least one counter-contact element.

7. An electromagnetic relay according to claim 6, wherein said second end of the contact leaf spring is connected to the armature through an insulating plastic rivet.

8. An electromagnetic relay according to claim 3, wherein said contact spring is generally conformally shaped corresponding to the inner side walls of said contact chamber, the first end of said spring being fastened to its corresponding terminal at one side or adjacent to the second core leg, the central spring portion being embraced or included between two center-contact elements close to a side of the base body opposite said second core leg and adjacent to said first armature arm and the second leaf spring end portion extends essentially parallel to said second armature arm and is connected thereto near the free end thereof.

9. An electromagnetic relay according to claim 8, wherein said second end portion of the contact leaf spring is connected to the armature through an insulating plastic rivet.

10. An electromagnetic relay according to claim 1, wherein said armature is generally L-shaped having a first arm pivoted against said first core leg and a second arm extending generally perpendicular to said first armature arm and parallel to said first core leg, a free end of said second armature arm and the free end of said second core leg forming said working air gap, and wherein the base body has an extension extending in the direction of said coil axis beyond said second core leg forming a contact chamber containing said contact assembly.

11. An electromagnetic relay according to claim 1, wherein said armature is generally L-shpped having a first arm pivoted against said first core leg and a second arm extending generally perpendicular to said first armature arm and parallel to said first core leg, a free end of said second armature arm and the free end of said second core leg forming said working air gap, and wherein the base body has an extension extending in the direction perpendicular to said coil axis beyond said second armature arm forming a contact chamber containing said contact assembly.

12. An electromagnetic relay according to claim 1, wherein said base body has side walls perpendicular to said bottom side forming a casing and a cover for closing on said side walls.

13. An electromagnetic relay according to claim 12, wherein said base body has additional partition walls and/or protrusions for fixing and insulating at least part of said coil, core and contact assembly.

14. An electromagnetic relay according to claim 13, wherein said base body has additional stopper elements for said armature.

* * * * *